US005092278A

United States Patent [19]

Gold et al.

[11] Patent Number: 5,092,278

[45] Date of Patent: Mar. 3, 1992

[54] NON-WELDED ATTACHMENT TUBE SUPPORT LUG CASTING

[75] Inventors: Michael Gold, Alliance; George H. Harth, Wadsworth; James E. Ingersoll, Clinton; John J. Kidwell, Louisville; John M. Nielsen, Alliance; Edward F. Radke, Wadsworth, all of Ohio

[73] Assignee: The Babcock & Wilcox Company, New Orleans, La.

[21] Appl. No.: 576,305

[22] Filed: Aug. 31, 1990

[51] Int. Cl.[5] ..... F22B 37/24

[52] U.S. Cl. ..... 122/6 A; 122/512

[58] Field of Search ..... 122/6 A, 511, 512

[56] References Cited

U.S. PATENT DOCUMENTS 4,627,386 12/1986 Duffy et al. ..... 122/512

4,961,402 10/1990 Delsol ..... 122/512

*Primary Examiner*—Henry C. Yuen

*Attorney, Agent, or Firm*—Vytas R. Matas; Robert J. Edwards; Daniel S. Kalka

[57] ABSTRACT

A support lug casting for supporting a ferritic tube from an adjacent tube comprising male and female lugs formed on a ring shaped member and engaged around but not welded to each tube. The male lug of one tube engages into the female lug of an adjacent tube. The lugs and rings are made of austenitic material which resist corrosion and heat and which avoids the problem of welding dissimilar materials to each other since no welded connection is established between the austenitic casting and the ferritic tube. The casting is axially fixed on the tube by one or more ferritic stops or weld areas which are at one or both axial ends of each casting.

10 Claims, 3 Drawing Sheets

FIG. 1 (PRIOR ART)
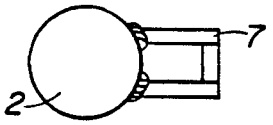
FIG. 3 (PRIOR ART)
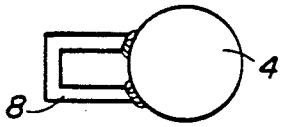
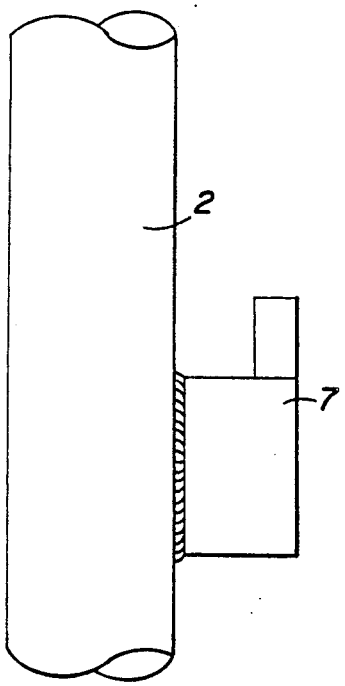
FIG. 2 (PRIOR ART)
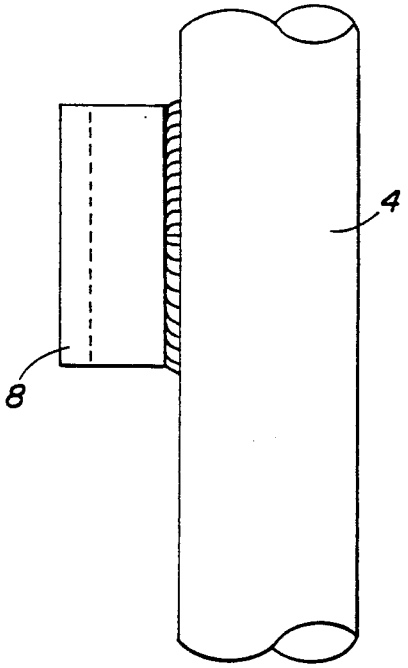
FIG. 4 (PRIOR ART)
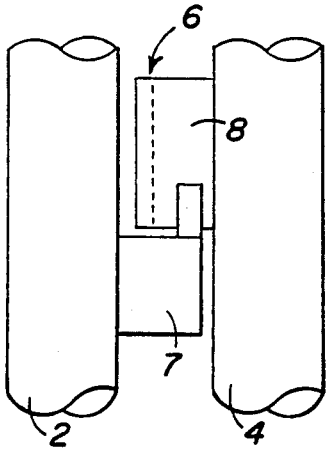
FIG. 5 (PRIOR ART)

FIG. 6
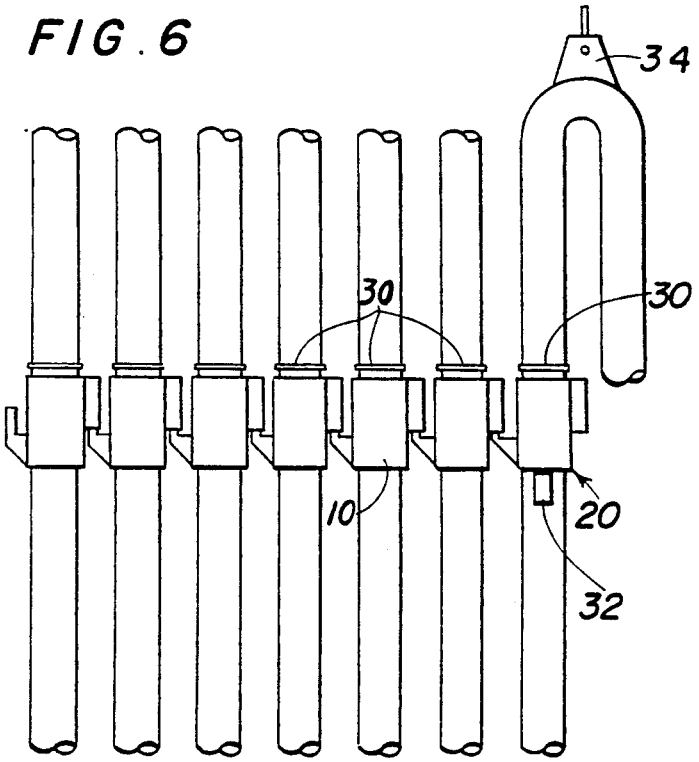
FIG. 7
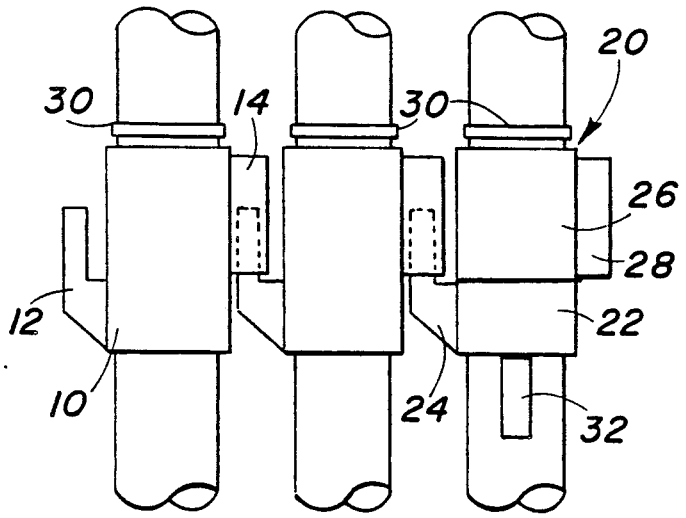
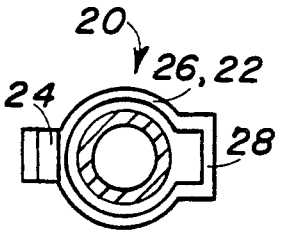
FIG. 8

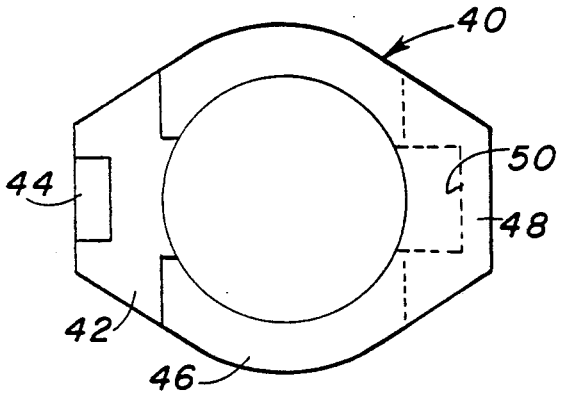
FIG. 9
FIG. 10
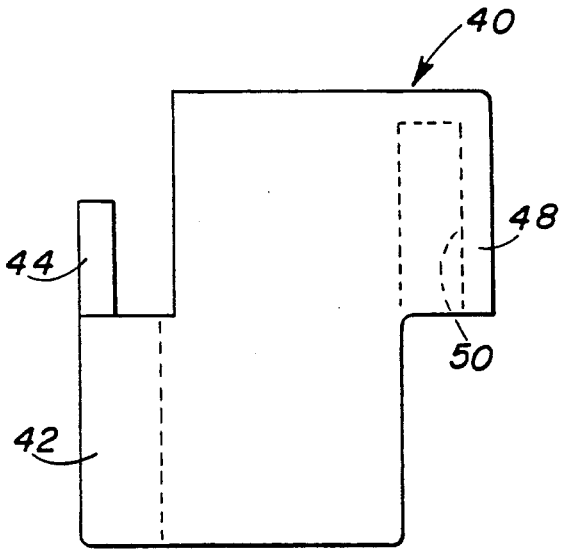
FIG. 12
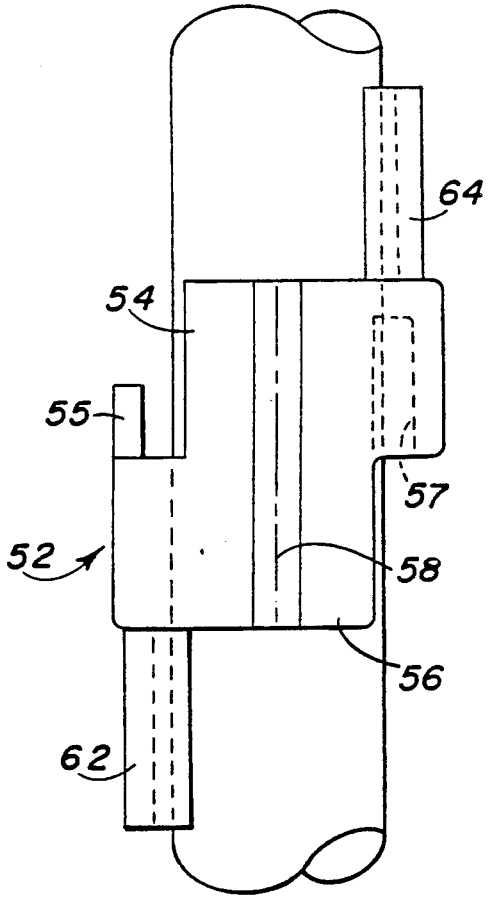
FIG. 11
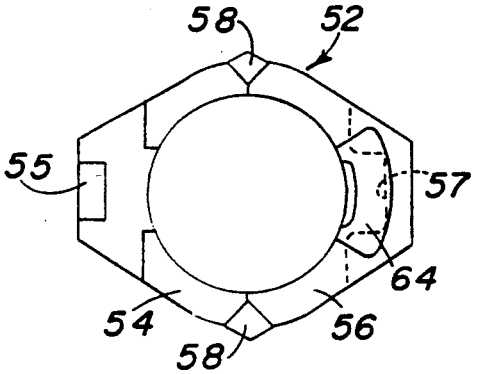

NON-WELDED ATTACHMENT TUBE SUPPORT LUG CASTING

FIELD AND BACKGROUND OF THE INVENTION

The present invention relates in general to boiler tube supports, and in particular to a new and useful arrangement for attaching adjacent tubes to each other without the use of dissimilar metal welding.

Support lug castings are often used to support and/or transfer structural loads between adjacent boiler tubes. A typical installation of a traditional support lug casting arrangement that involves welding support lug castings to the tubes (a male lug casting to one tube and a female lug casting to an adjacent tube) is shown schematically in FIGS. 1 to 5. During boiler operation, flow through the tubes generally keeps the tube metal temperature at 1050° F. or less. However, the lug castings welded to the tubes to support the tubes have limited cooling by this flow and thus operate at a higher temperature. Thus, lug castings fabricated from low chromium-containing ferritic material are susceptible to creep damage and to oxidation. Higher chromium-containing ferritic stainless steel castings are not used because of the welding difficulties they present. In order to avoid or minimize lug casting creep and oxidation in this elevated temperature environment, austenitic rather than ferritic castings, are generally used because of their improved creep and oxidation resistant characteristics.

FIG. 5 is a side elevational view of two adjacent ferritic tubes 2 and 4 which are engaged with each other by a lug casting assembly generally designated 6. As best shown in FIGS. 1 to 4, a male lug casting 7 is welded to the side of tube 2 and a female lug casting 8 is welded to the side of tube 4. When assembled, an integral tab extending upwardly from casting 7 is hooked under the casting 8 so that tube 4 in effect is supported by tube 2.

The use of austenitic castings, although attractive for creep and oxidation resistant properties necessitates a dissimilar metal weld between the castings and the ferritic tubes. In certain boiler applications, this dissimilar weld attachment has failed and, in some cases, been the source of through-wall failures of the tube.

Attempts by most designers of support lug castings to eliminate these failures have focused upon changing or improving the weld materials and/or process associated with the dissimilar metal weld. No significant activity has been directed toward eliminating the dissimilar metal weld all together.

The dissimilar metal weld would be eliminated by using austenitic tubes. This alternative, however, has generally not been given much consideration because of the added cost of austenitic tubes. Another alternative to eliminate the failures associated with dissimilar weld lug castings which has been considered is to eliminate the lug castings and support the boiler tubes from above. This alternative is not attractive because of boiler space limitations, the required boiler modifications and the associated costs.

SUMMARY OF THE INVENTION

As an alternative to welding an austenitic support casting to a tube, the present invention provides a support lug casting design configuration that can be slipped over the tube and moved axially. One embodiment of the invention uses a non-welded attachment support lug casting geometry that includes both a male and female configuration in the same part. Clearance between the lug ID and the tube OD allows the lug casting to be installed on the tube and positioned axially as desired. In order to secure the lug casting in the proper position to support tube loads and/or transfer loads, a ferritic weld deposit on the ferritic tube above or below the casting is required to act as a shear lug. Alternatively, a block of ferritic material is welded to tube either above or below the casting as required.

In another embodiment of the invention, separate male and female parts are welded to each other, but not to the ferritic tube. These parts are also positionally fixed on the ferritic tube by ferritic stops which are welded to the tube.

Accordingly, an object of the present invention is to provide an arrangement for supporting adjacent ferritic tubes in a boiler, comprising: first hanging means radially fixed and non-welded at an axial location to a first ferritic tube, said first hanging means having opposite axial ends; the first hanging means having a male and female lug with at least one ring fixed to the male and female lugs engaged around the tube second hanging means radially fixed and non-welded at an axial location to a second tube which is adjacent the first tube, said second hanging means having opposite axial ends, the second hanging means having a male and female lug with at least one ring fixed to the male and female lugs around the tube, the second hanging means being engagable with said first hanging means for transmitting axial loads between the first and second tubes; and at least one ferritic stop fixed to each tube adjacent one of the axial ends of the hanging means radially fixed to the tube for axially fixing each hanging means on its respective tube.

A further object of the present invention is to fix the ferritic stop by ferritic welding to the ferritic tube and to provide each of the male and female hanging means in the form of ring segments which are austenitically welded to each other around each tube, but not to the tube.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 1 is a top plan view of a conventional male lug casting fixed to a boiler tube;

FIG. 2 is a side elevational view of FIG. 1;

FIG. 3 is a plan view of a conventional female lug casting welded to a boiler tube;

FIG. 4 is a side elevational view of FIG. 3;

FIG. 5 is a side elevational view of conventional male and female lug castings engaged with each other for transmitting axial loads between adjacent tubes;

FIG. 6 is a side elevational view of the arrangement for supporting adjacent tubes in a boiler, according to the present invention;

FIG. 7 is an enlarged detail taken from FIG. 6;

FIG. 8 is a top plan view of the ring shape combined male and female lug used in the embodiment of FIGS. 6 and 7;

FIG. 9 is a top plan view of a combined lug casting according to a second embodiment of the invention;

FIG. 10 is a side elevational view of FIG. 9;

FIG. 11 is a view similar to FIG. 9 of a third embodiment of the invention; and

FIG. 12 is a side elevational view of FIG. 11 showing the casting of the invention mounted and fixed on a boiler tube.

DESCRIPTION OF THE PREFERRED EMBODIMENTS

Referring to the drawings in particular, the invention therein in FIGS. 6 through 12 comprises a support lug casting having a substantially ring shaped configuration and incorporating both male and female components, for transmitting axial loads between adjacent, preferably ferritic, boiler tubes.

As best shown in FIG. 8, the lug casting of the invention comprises a ring shaped member 26,22 having a male lug 24 at a lower axial end on one radial side of the ring, and a female lug 28 at an opposite axial end on the opposite radial side of the ring. The female lug has a slot shaped recess extending axially therethrough and receives the axially extending hook-shaped projection of the male lug on an adjacent tube.

Although both a male lug 12 and female lug 14 can be provided on the same ring 10, the lug castings generally designated 20 at the right of FIG. 7 comprises a lower ring 22 which carries the male lug 24 and an upper ring 26 which carries the female lug 28. These can be positioned axially immediately one next to the other as shown in FIG. 7, or spaced from each other along the length of the tube. This requires relocation of mating respective female and male lugs on adjacent tubes.

The rings and lugs of the invention are advantageously made of temperature and corrosion resistant austenitic alloy which is different from the ferritic composition of the tubes themselves.

While the ring-shaped form of the support lug castings radially fixes each casting to its respective tube, in a non-welded manner, axial fixing of each casting is also required.

This is accomplished by a ferritic weld buildup shown for example at 30, above the upper axial end of each casting. This forms one axial stop which is made of the same material as the tube and thus avoids the problem of welding dissimilar materials.

Some of the lug castings, for example, casting 20, may also include a second stop in the form of a ferritic material piece 32 which is welded to the ferritic tube.

As shown in FIG. 6, a hanger 34 may be connected to the first tube which then transmits the vertical axial force to the subsequent adjacent tubes, one after the other. If only upward axial force is to be transmitted, generally only the upper axial stop is needed. Since the first lug casting 20 must support these upper forces in a downwardly directed axial manner, the second stop 32 is also required.

By utilizing the closed ring 10 in the embodiments of FIGS. 6–8, the lug casting of the invention must be slipped over an end of the tube for radially engaging the casting to the tube.

FIGS. 9 and 10 illustrate another embodiment of the invention which comprises a non-welded attachment support lug casting 40 in the form of an interlocking casting support ring. The embodiment of FIGS. 11 and 12 is essentially the same support casting design except that it can be fabricated in two parts and the two parts joined by welding after properly positioned on the tube. FIG. 12 also shows a shear lug positioned above and below the support casting. It is important to note that none of the welds that would be required to implement this approach would be dissimilar metal welds and thus would not be expected to fail in modes typical of dissimilar metal welds.

Returning to the embodiment of FIGS. 9 and 10, casting 40 may either be cast as a single part or formed by separate parts 42, which carry a male lug 44, and 46 which carry the female lug 48 with recess 50 for receiving the male lug.

In the embodiment of FIGS. 11 and 12, the lug casting 52 comprises ring halves 54 and 56 which are connected by austenitic welding along vertical joining lines 58. Casting half 54 carries the male lug 55 while casting half 56 carries the female lug which contains recess 57.

A lower axial stop 62 is made of the same material as the tube, or of another suitable ferritic alloy material, and is welded to the tube at the lower axial end of the casting 52 while a similar lug 64 is welded to the tube at the upper axial end of casting 52.

The invention uses a non-welded attachment support lug casting geometry that can be installed, positioned axially, and used to support or transfer load without creating a dissimilar weld between the austenitic lug casting and the ferritic tube. This is desired because it eliminates the main source of the problem that has been encountered in past years for such tube support applications. The invention offers the opportunity to use one casting rather than two, by incorporating both the male and female casting together into the same part. By incorporating both the male and female casting together into the same part, it creates better inplane alignment of the male casting side and the female casting side. The lug casting design is appropriate not only for new applications but offers time savings and is applicable for retrofitting existing installations. Finally, and perhaps most importantly, it requires much less weld related costs.

While specific embodiments of the invention have been shown and described in detail to illustrate the application of the principles of the invention, it will be understood that the invention may be embodied otherwise without departing from such principles.

What is claimed is:

1. An arrangement for supporting adjacent tubes in a boiler, comprising:

first hanging means radially fixed and non-welded at an axial location to a first tube, said first hanging means having opposite axial ends, said first hanging means having a male and female lug with at least one ring fixed to said male and female lugs engaged around the tube;

second hanging means radially fixed and non-welded at an axial location to a second tube which is adjacent the first tube, said second hanging means having opposite axial ends, said second hanging means having a male and female lug with at least one ring fixed to said male and female lugs around the tube, said second hanging means being engageable with said first hanging means for transmitting axial loads between the first and second tubes; and at least one stop fixed to each tube adjacent to one of the axial ends of the hanging means radially fixed to the tube for axially fixing each hanging means on its respective tube.

2. An arrangement according to claim 1 including a separate lug connected to each of said male and female lugs on each respective tube.

3. An arrangement according to claim 1 including a single ring fixed to both said male and female lugs on each respective tube.

4. An arrangement according to claim 1 wherein said ring, said male lug and said female lug are all formed as one piece of austenitic material.

5. An arrangement according to claim 1 wherein said ring comprises a first ring half connected to said male lug a second ring half connected to said female lug, said ring halves and lugs being made of different material than the ferritic tubes, said ring halves being welded to each other around a tube.

6. An arrangement according to claim 1 wherein said female lug includes a recess shaped to receive said male lug.

7. An arrangement according to claim 1 wherein said first and second hanging means are each made of austenitic material.

8. An arrangement according to claim 1, wherein said ring, said male lug and said female lug are all formed as one piece of creep and oxidation resistant material.

9. An arrangement according to claim 1, wherein said first and second hanging means are each made of creep and oxidation resistant material.

10. An arrangement according to claim 1, wherein said tubes are made of ferritic material.

* * * * *